US007847173B1

(12) United States Patent
Jones

(10) Patent No.: US 7,847,173 B1
(45) Date of Patent: Dec. 7, 2010

(54) COMPACT DEVICE FOR ADJUSTING PIANO KEY TOUCH WEIGHT

(75) Inventor: Marvin Scott Jones, Boalsburg, PA (US)

(73) Assignee: Pitchlock Inc., Boalsburg, PA (US)

( * ) Notice: Subject to any disclaimer, the term of this patent is extended or adjusted under 35 U.S.C. 154(b) by 0 days.

(21) Appl. No.: 12/454,358

(22) Filed: May 18, 2009

(51) Int. Cl.
*G10C 3/12* (2006.01)

(52) U.S. Cl. ..... 84/440; 84/439; 84/423 R; 84/26; 84/27

(58) Field of Classification Search ..... 84/439, 84/440, 26, 27, 423 R
See application file for complete search history.

(56) References Cited

U.S. PATENT DOCUMENTS

| | | | | | |
|---|---|---|---|---|---|
| 391,940 | A | * | 10/1888 | Brooks | 84/440 |
| 489,564 | A | * | 1/1893 | Long | 84/440 |
| 774,961 | A | * | 11/1904 | Ward | 84/440 |
| 804,051 | A | * | 11/1905 | Rohlfing, Jr. | 84/440 |
| 1,589,745 | A | * | 6/1926 | Federle | 84/433 |
| 2,601,217 | A | * | 6/1952 | Zuck | 84/423 R |
| 2,911,874 | A | * | 11/1959 | Gunther | 84/439 |
| 2,999,411 | A | * | 9/1961 | Rice | 84/439 |
| 3,026,760 | A | * | 3/1962 | Fauser | 84/423 R |
| 4,381,691 | A | * | 5/1983 | Conklin et al. | 84/440 |
| 4,686,879 | A | | 8/1987 | Ito et al. | |
| 5,079,985 | A | * | 1/1992 | Yamaguchi et al. | 84/719 |
| 6,096,959 | A | | 8/2000 | Davide | |
| 6,649,821 | B2 | | 11/2003 | Inoue | |
| 6,774,294 | B2 | | 8/2004 | Kugimoto et al. | |
| 7,129,404 | B2 | | 10/2006 | Inoue | |
| 7,402,741 | B2 | * | 7/2008 | Funaki et al. | 84/423 R |

OTHER PUBLICATIONS

The Inner Workings of One Note in a Grand Piano, illustrated a key stop rail, © Oct. 2000, viewed Jan. 25, 2010 at http://www.concertpitchpiano.com/GrandActionModel.html.*

Schematic of the Steinway Model M Grand Piano, Indicates a Key Stop Rail (item 13), © 2009, viewed Jan. 25, 2010 at http://www.steinway.com/technical/schematic_5.shtml.*

* cited by examiner

*Primary Examiner*—Elvin G Enad
*Assistant Examiner*—Robert W Horn

(57) ABSTRACT

A series of adjustable springs, rigidly suspended above the keys of a piano, provides a downward force which reduces the effort needed to depress the keys. Precise adjustment of the series, and its attachment to the piano are facilitated through the use of existing fastener hardware within the conventional piano architecture.

6 Claims, 5 Drawing Sheets

COMPACT DEVICE FOR ADJUSTING PIANO KEY TOUCH WEIGHT

| References Cited: | U.S. PATENT DOCUMENTS | | |
|---|---|---|---|
| | 6,096,959 | August 2000 | Davide |
| | 4,381,691 | May 1983 | Conklin Jr. et. al. |
| | 6,649,821 B2 | November 2003 | Inoue |
| | 7,129,404 B2 | November 2006 | Inoue |
| | 4,686,879 | August 1987 | Ito et. al. |
| | 6,774,294 B2 | August 2004 | Kugimoto et. al. |
| | 2,911,874 | November 1959 | Gunther |

BACKGROUND OF THE INVENTION

1. Field of the Invention

The invention relates to grand pianos and more particularly to such means whereby key touch resistance can be adjustably controlled by a device, efficiently installed within the limited space of the grand piano cabinetry. without permanently altering its original components .

2. Description of the Prior Art

Virtually all musical keyboard instruments have a conventional arrangement of keys which, when depressed, produce musical sounds. In the case of acoustic pianos, keys are typically pivotally mounted levers which transfer an input finger force into the piano action assembly. The design orientation of acoustic pianos can be either vertical, as in the case of upright pianos, or horizontal as with grand pianos. Even within the finest piano actions, substantial mass, inertia, spring and friction forces are present and must be carefully adjusted for balance and consistency, creating a tactile characteristic known as "touch weight" within the keyboard . When pianos age, this touch weight can degrade due to rising levels of friction and misalignment among the rotating and sliding components of the action. This touch weight increase can also occur when worn components within the action are replaced with new parts which are heavier than the original parts. The touch weight increase can produce an unpleasant sense of heaviness and slow key acceleration. It can also degrade unevenly between the keys resulting in inconsistent action response. This tendency toward heavy touch weight is especially prevalent in grand pianos which have horizontally oriented action mechanisms which must rotate upward against the force of gravity. The only conventional remedy for this problem, beyond the scope of routine adjustment and lubrication, is the removal addition or relocation of existing mass loading components such as the lead ballast weights which are This process of action weight adjustment is a specialized art. Recent examples are taught by Davide (U.S. Pat. No. 6,096,959), Inoue (U.S. Pat. No. 7,129,404 B2), Ito et. al. (U.S. Pat. No. 4,686,879) and Kugimoto et. al. (U.S. Pat. No. 6,774,294, B2). Additionally, numerous mechanical devices for the control of grand piano action touch weight have been created. Typically, these devices apply various forces of either gravitational, mechanical or electro-magnetic origin to the piano keys. Examples of these devices are instructed by Conklin Jr. et. al.(U.S. Pat. No. 4,381,691) Inoue (U.S. Pat. No. 6,649,821 B2) and Gunther (U.S. Pat. No. 2,911,874). Such devices can be difficult to adjust because their location within the piano is not easily accessible. The devices can be costly to manufacture and can require significant modification to the existing piano. The devices can be difficult to remove, hindering conventional service access to other regions of the action.

When grand pianos are transported, they must be tilted and rotated in order to move the instrument through small openings such as doorways and stairwells. This tilting process can easily dislodge the keys from the action, resulting in damage to the keys, action or cabinetry. To prevent this, grand piano actions are equipped with a key stop rail, made of wood or metal, rigidly suspended above and in close proximity to the key upper surfaces. The key stop rail is strategically positioned to limit excessive upper movement of the keys while not interfering with moving cabinet panels or blocking access to adjustment points within the action. Also, the key stop rail is easily removable, facilitating adjustment and service of the keys.

SUMMARY OF THE INVENTION

The invention replaces a grand piano's existing key stop rail with a spatially compact, self-contained key touch weight adjustment device. It is rigidly suspended above the key top surfaces, using components from the original key stop rail fastening hardware. The invention contains a series of adjustable springs which applies a downward compressive force to the keys of the piano, reducing the amount of finger input force needed to depress the keys. The location of the invention does not interfere with the existing piano cabinetry. This position also permits easy installation, adjustment and removal of the invention and demands no permanent modification of the original instrument components.

DETAILED DESCRIPTION OF THE INVENTION

Figure 1:
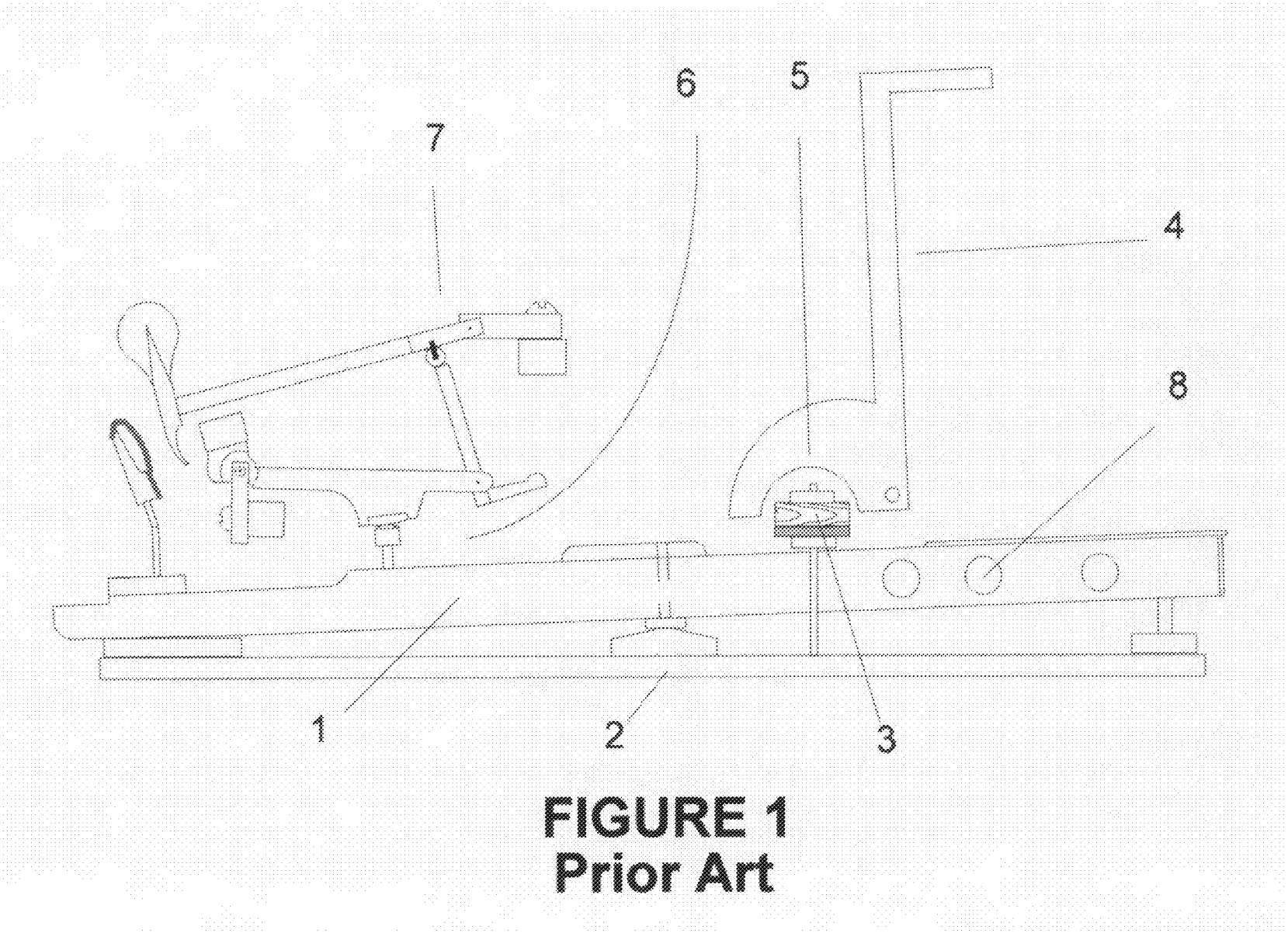
FIGURE 1 Prior Art
FIG. 1 is a side view of the traditional grand piano key action, emphasizing the location of the key stop rail and piano case components.

FIG. 1 illustrates a traditional grand piano key 1, pivotally resting on a key frame 2. A key stop rail 3 is rigidly suspended above the keys to prevent their upward movement and possible dislocation during piano transport. Typical grand piano cabinetry includes a rotating key lid 4 which folds down to cover the keys. During use, the key lid is raised to a vertical position to expose the keyboard. This rotates a portion of the key lid body into close proximity with the keys and, in particular, the key stop rail. Consequently, most key lid designs include a machined clearance space 5 which prevents contact between the key lid and key stop rail. FIG. 1 also illustrates the narrow horizontal opening 6 which exists between the key plane and the remaining action components 7. The opening is necessary for access, from the front of the action, to important adjustment mechanisms deep within the action and must, therefore not be blocked by an excessively large key stop rail. The weight of downstream action components rests on the rear portion of the key and is typically offset by a series of immovable lead ballast weights 8 which are tightly pressed into holes within the front portion of the key body.

Figure 3:
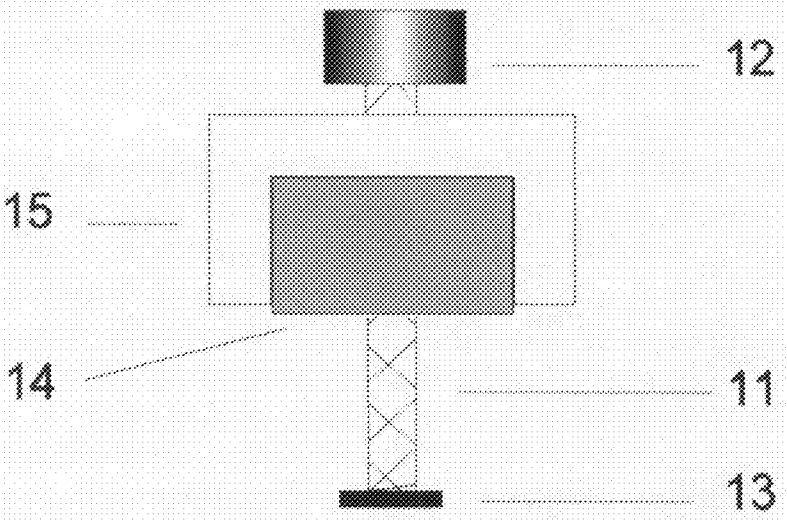
FIG. 3 shows a cross sectional view of the preferred embodiment of the invention.
Figure 2:
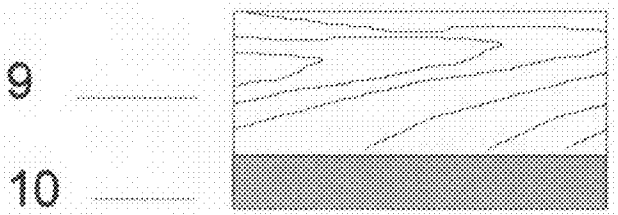
FIGURE 2 Prior Art
FIG. 2 shows a cross sectional view of the traditional key stop rail.

Drawing sheet 2 shows comparative cross sectional views of both the traditional stop rail and the invention. A key stop rail, such as that shown in FIG. 2 is typically made of solid wood 9. The bottom surface of the rail is covered with a layer of felt, foam or similar material that can dampen noise caused by contact with the key surfaces during performance 10. A preferred embodiment of the invention is shown in FIG. 3. The body of the invention is spatially similar to the cross section of a traditional key stop rail. A series of vertically mounted compression springs 11 are positioned to align with the keys of the piano. Attached to each spring is a cylindrical cap 12 for ease of finger adjustment, and a cushion tip 13 of felt that prevents noise between springs and keys. The springs are held in place by a perforated core of felt, plastic or other elastic material 14. The elastic properties of the core material apply a gripping force to the spring. This gripping force prevents vertical linear movement of the spring while permitting its rotational adjustment. Therefore force, such as that applied by an upwardly rotating surface of a piano key, does not move the spring upward in within the core. The spring can, therefore, impart a reliable compressive force against the key surface. But if the spring is rotated, as with a threaded screw, its static vertical position can be changed, permitting adjustment of its position and its compressive force, relative to the piano key. The core and spring assembly are affixed to an outer channel of metal or other stiff material 15. As with the traditional key stop rail, the preferred embodiment is rigidly secured, at regular intervals along its length, to the key frame. These fastener points are made to be identical to the original key stop rail fastener positions so not cutting, drilling or permanent modification of the original instrument design is required to install the invention. Adjustably raising or lowering the assembly moves it closer to or farther from the keys, thereby changing the amount of compressive force which the assembly imparts onto the entire keyboard. This rail height adjustment and its subsequent change in spring force against the keys, enables touch weight to be changed quickly throughout the entire keyboard. Additionally, a finer level of independent spring adjustment can be produced by rotating springs individually within the elastic core. As a result, touch weight for each individually adjusted spring can be carefully controlled and a high degree of note-to-note touch weight precision and consistency can be achieved.

Figure 4:
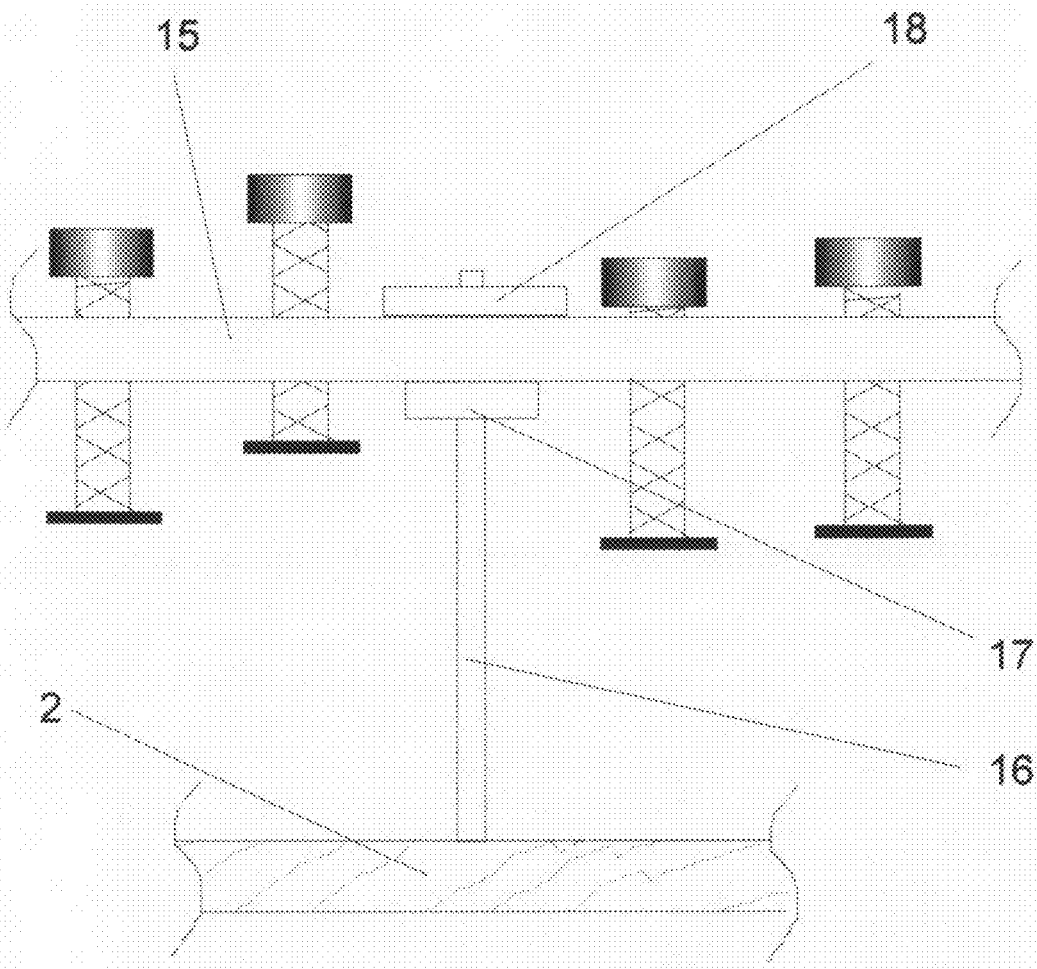
FIG. 4 shows a front view of a section of the preferred embodiment of the invention, including individual springs and height adjustment components.

In FIG. 4, the invention is seen from a front perspective. conventional vertical threaded posts 16 are secured to the keyframe 2. Onto these posts, the invention assembly is secured above the piano keys by a lower nut 17 and upper nut 18 which, together, vertically position and clamp the rigid rail 15 onto the threaded posts. Through this simple attachment means, the invention position can be vertically adjusted, easily removed and replaced, and securely locked to the action. FIG. 4 also illustrates that individual spring heights are independently adjustable, as seen in their non uniform heights.

Figure 5:
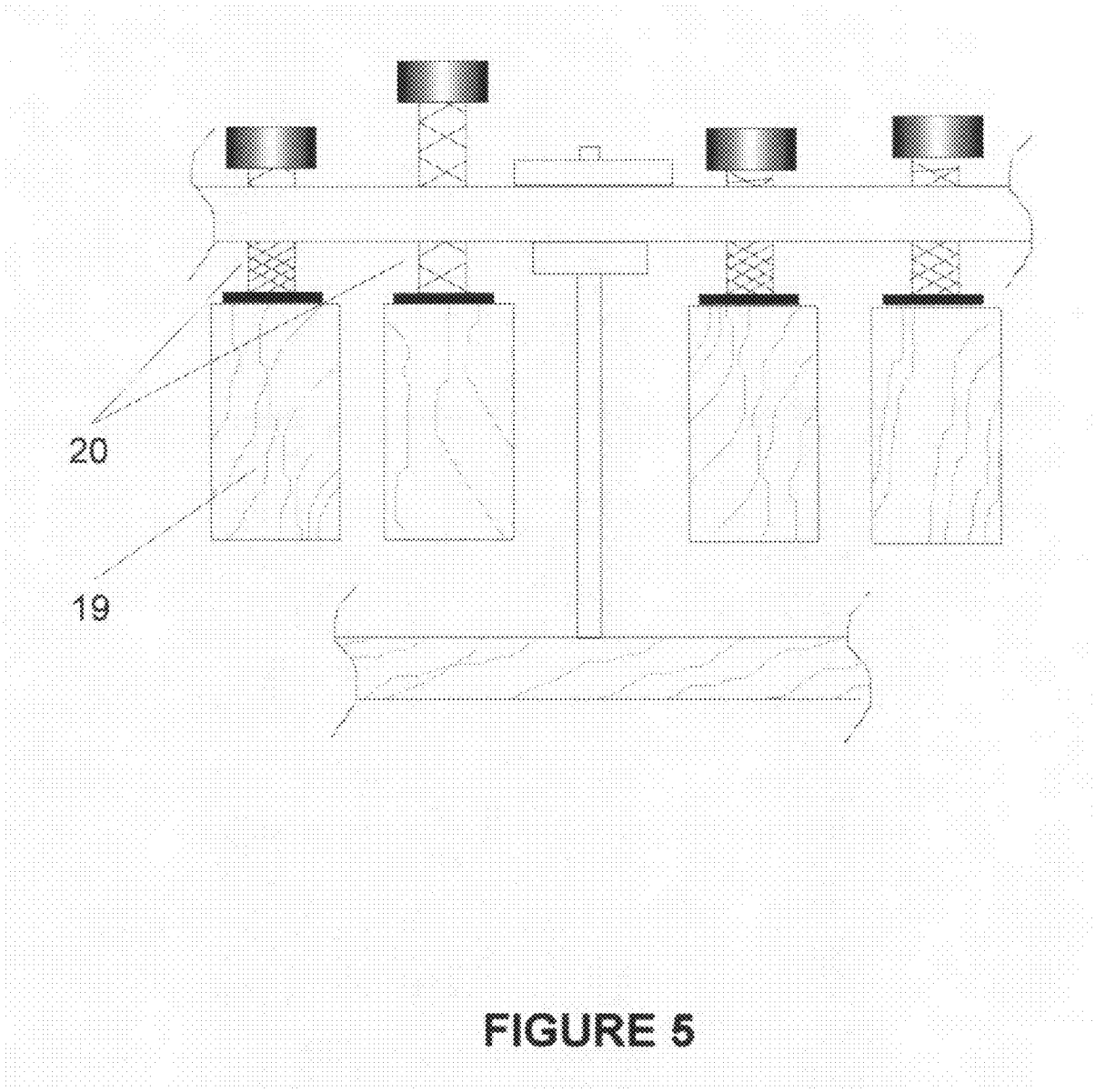
FIG. 5 shows the same front view as in FIG. 3 but with the addition of piano keys beneath the invention, emphasizing variable spring compression between the invention and the piano keys.

FIG. 5 shows the same assembly as in FIG. 4, but with the addition of piano keys, shown in frontal cross section 19, resting beneath the invention. It can be seen that the varied spring heights, shown in FIG. 4 are now shown as varied spring compressions 20, which apply different amounts of downward force into the individual keys depending on their chosen adjusted positions. These adjustable spring forces are considered to be an important benefit of the invention since they can systematically counter the uneven touch weight characteristics within a grand piano keyboard.

Figure 6:
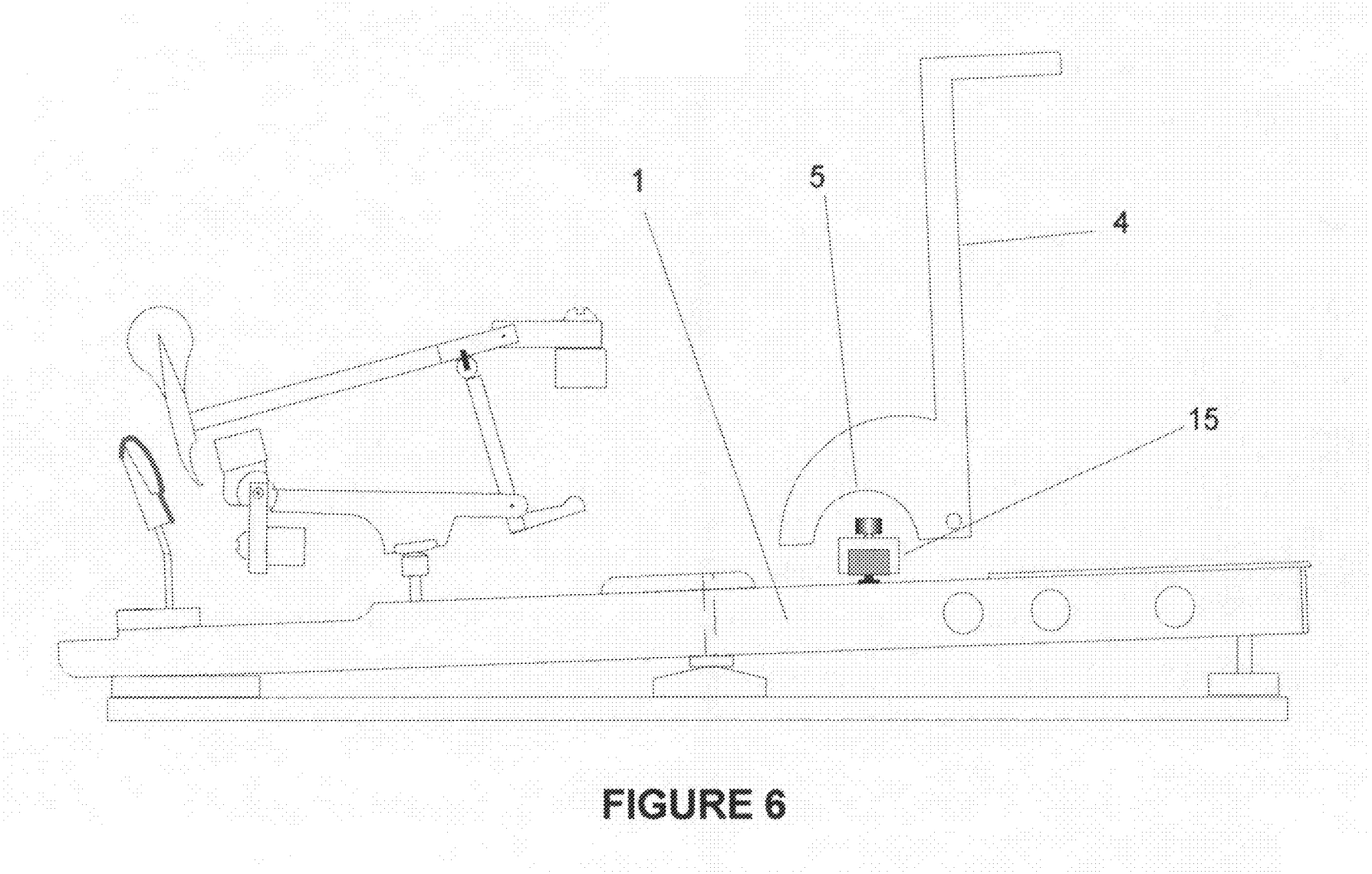
FIG. 6 shows the conventional grand piano key action with the invention having replaced the traditional key stop rail.

FIG. 6 shows the traditional grand piano key action in side view. The rigid body of the invention 15 is located between key 1 and key lid 4 within the opening created by the key lid clearance space 5 where the traditional key stop rail would normally be located.

What is claimed:

1. A grand piano containing a series of keys pivotally mounted onto a frame to which is attached a removable limiting rail, adjustably suspended above the keys, and a device spatially similar to said limiting rail but with additional structural capability, which can be installed as a replacement for an original limiting rail and which rigidly contains a series of compression springs positioned to contact said series of keys for the purpose of producing a series of forces against said keys in order to reduce the work required to depress said keys, wherein each compression spring is frictionally captured so as to prevent vertical motion of said spring when subjected to vertical compression yet to permit vertical motion of said spring when subjected to helical rotation.

2. The grand piano of claim 1 wherein a cylindrical cap is attached to each compression spring for ease of finger adjustment.

3. The grand piano of claim 1, wherein a cushion tip of felt is provided between the springs and the keys.

4. The grand piano of claim 1, wherein the springs are captured by a perforated core of felt, plastic, or other elastic material.

5. The grand piano of claim 1 wherein the limiting rail provides fastener points identical to the fastener points of said original limiting rail.

6. The grand piano of claim 1, wherein the spring heights are independently adjustable.

* * * * *